US011952999B2

(12) United States Patent
Zhang et al.

(10) Patent No.: US 11,952,999 B2
(45) Date of Patent: Apr. 9, 2024

(54) PLUNGER PUMP BASE AND PLUNGER PUMP DEVICE

(71) Applicant: YANTAI JEREH PETROLEUM EQUIPMENT & TECHNOLOGIES CO., LTD., Shandong (CN)

(72) Inventors: Peng Zhang, Shandong (CN); Rikui Zhang, Shandong (CN); Xiaolei Ji, Shandong (CN); Chunqiang Lan, Shandong (CN); Sheng Chang, Shandong (CN); Liang Lv, Shandong (CN); Xincheng Li, Shandong (CN); Lintao Song, Shandong (CN); Weiqiang Liu, Shandong (CN)

(73) Assignee: Yantai Jereh Petroleum Equipment & Technologies Co., Ltd., Yantai (CN)

( * ) Notice: Subject to any disclaimer, the term of this patent is extended or adjusted under 35 U.S.C. 154(b) by 148 days.

(21) Appl. No.: 17/360,622

(22) Filed: Jun. 28, 2021

(65) Prior Publication Data

US 2022/0282726 A1 Sep. 8, 2022

(30) Foreign Application Priority Data

Mar. 8, 2021 (CN) ..... 202120488503.3

(51) Int. Cl.

| | |
|---|---|
| ***F04B 53/22*** | (2006.01) |
| ***F04B 17/06*** | (2006.01) |
| ***F04B 47/00*** | (2006.01) |

(52) U.S. Cl.

CPC ..... *F04B 53/22* (2013.01); *F04B 17/06* (2013.01); *F04B 47/00* (2013.01)

(58) Field of Classification Search

CPC ..... F04B 17/00; F04B 17/03; F04B 17/06; F04B 23/00; F04B 23/025; F04B 23/04;

(Continued)

(56) References Cited

U.S. PATENT DOCUMENTS

| | | | | |
|---|---|---|---|---|
| 8,408,886 | B2 | 4/2013 | Fabbri | |
| 2017/0030177 | A1* | 2/2017 | Oehring | E21B 7/02 |

(Continued)

FOREIGN PATENT DOCUMENTS

| | | | |
|---|---|---|---|
| CN | 103410494 | A | 11/2013 |
| CN | 104948876 | A | 9/2015 |

(Continued)

*Primary Examiner* — Essama Omgba
*Assistant Examiner* — Chirag Jariwala
(74) *Attorney, Agent, or Firm* — Crowell & Moring LLP

(57) ABSTRACT

A plunger pump base and a plunger pump device. The plunger pump base includes a support assembly and an extension assembly. The support assembly includes a top plate, a bottom plate and a support frame, the top plate and the bottom plate are oppositely arranged at an interval, and the support frame is respectively fixed with the top plate and the bottom plate. The extension assembly includes an extension block, a first telescopic mechanism and a second telescopic mechanism. One end of the first telescopic mechanism is rotatably connected to the extension block, the other end of the first telescopic mechanism is rotatably connected to the top plate. One end of the second telescopic mechanism is rotatably connected to the extension block, and the other end of the second telescopic mechanism is rotatably connected to the bottom plate.

16 Claims, 5 Drawing Sheets

(58) Field of Classification Search
CPC ..... F04B 23/06; F04B 47/00; F04B 53/22; E21B 7/02; E21B 43/12; E21B 43/26; E21B 43/2607; F16M 1/00; F16M 5/00; F16M 7/00; A47B 91/005
USPC ..... 248/637, 638, 678, 346.01, 346.02, 248/555–557, 656; 417/360
See application file for complete search history.

(56) References Cited

U.S. PATENT DOCUMENTS

| | | | | |
|---|---|---|---|---|
| 2018/0328157 | A1* | 11/2018 | Bishop | F04B 17/06 |
| 2020/0109616 | A1* | 4/2020 | Oehring | F04B 1/00 |
| 2021/0095598 | A1* | 4/2021 | Yeung | F04B 17/00 |
| 2022/0220952 | A1* | 7/2022 | Louzon | F04B 53/003 |

FOREIGN PATENT DOCUMENTS

| | | | | | |
|---|---|---|---|---|---|
| CN | 205714145 | U | | 11/2016 | |
| CN | 108412747 | A | | 8/2018 | |
| CN | 208686570 | U | | 4/2019 | |
| CN | 112555121 | A | * | 3/2021 | F04B 17/03 |

* cited by examiner

500

PLUNGER PUMP BASE AND PLUNGER PUMP DEVICE

TECHNICAL FIELD

Embodiments of the present disclosure relate to a plunger pump base and a plunger pump device.

BACKGROUND

In the field of oil and gas exploitation, fracturing technology is a method to make oil and gas reservoirs crack by using high-pressure fracturing fluid. Fracturing technology can improve the flowing environment of oil and gas underground by causing cracks in oil and gas reservoirs, thus increasing oil well production.

Plunger pump is a device that uses the reciprocating motion of plunger in cylinder to pressurize liquid. Plunger pump has the advantages of high rated pressure, compact structure and high efficiency, so it is used in fracturing technology.

SUMMARY

Embodiments of the present disclosure provide a plunger pump base and a plunger pump device. The plunger pump base is additionally provided with an extension block for bearing and fixing a plunger pump, and allows the extension block, a first telescopic mechanism and a second telescopic mechanism to form a triangular support mechanism with adjustable size. Therefore, upon the lengths of the first telescopic mechanism and the second telescopic mechanism being adjusted, the distance between the extension block and the support assembly will also change, so that it can be used for supporting and fixing plunger pumps of different sizes. In addition, the triangular support mechanism is stable in structure, thus providing stable support for the plunger pump. On the other hand, the plunger pump can be mounted on a beam of a carrier through the plunger pump base, without being disassembled directly on the beam, thus reducing the difficulty of disassembly and maintenance and reducing the damage probability of the plunger pump.

At least one embodiment of the present disclosure provides a plunger pump base, which includes a support assembly, including a top plate, a bottom plate and a support frame between the top plate and the bottom plate, the top plate and the bottom plate being oppositely arranged at an interval, and the support frame being respectively fixed with the top plate and the bottom plate; and an extension assembly, including an extension block, a first telescopic mechanism and a second telescopic mechanism, wherein one end of the first telescopic mechanism is rotatably connected to the extension block, the other end of the first telescopic mechanism is rotatably connected to the top plate, and the first telescopic mechanism is configured to extend or contract, one end of the second telescopic mechanism is rotatably connected to the extension block, the other end of the second telescopic mechanism is rotatably connected to the bottom plate, and the second telescopic mechanism is configured to extend or contract.

For example, in the plunger pump base provided by an embodiment of the present disclosure, a maximum telescopic length of the second telescopic mechanism is greater than a maximum telescopic length of the first telescopic mechanism.

For example, in the plunger pump base provided by an embodiment of the present disclosure, the extension assembly further includes: a first fixed ear-plate connected to the extension block; and a first connection shaft on the first fixed ear-plate, wherein the end of the first telescopic mechanism rotatably connected to the extension block is rotatably connected to the first connection shaft, and the end of the second telescopic mechanism rotatably connected to the extension block is rotatably connected to the first connection shaft.

For example, in the plunger pump base provided by an embodiment of the present disclosure, the first telescopic mechanism includes: a first joint bearing, one end of the first joint bearing being sleeved on the first connection shaft, and the other end of the first joint bearing including a first threaded connection portion; a second fixed ear-plate fixed with the top plate; a second connection shaft on the second fixed ear-plate; a second joint bearing, one end of the second joint bearing being sleeved on the second connection shaft, and the other end of the second joint bearing including a second threaded connection portion; and a first threaded rod, one end of the first threaded rod including a third threaded connection portion, the third threaded connection portion being connected to the first threaded connection portion by threads, and the other end of the first threaded rod including a fourth threaded connection portion, the fourth threaded connection portion being connected to the second threaded connection portion by threads.

For example, in the plunger pump base provided by an embodiment of the present disclosure, the first telescopic mechanism further includes: a first rotation nut sleeved on the third threaded connection portion of the first threaded rod; and a second rotation nut sleeved on the fourth threaded connection portion of the first threaded rod.

For example, in the plunger pump base provided by an embodiment of the present disclosure, the second telescopic mechanism includes: a third joint bearing, one end of the third joint bearing being sleeved on the first connection shaft, and the other end of the third joint bearing including a fifth threaded connection portion; a third fixed ear-plate fixed with the bottom plate; a third connection shaft on the third fixed ear-plate; a fourth joint bearing, one end of fourth joint bearing being sleeved on the third connection shaft, and the other end of fourth joint bearing including a sixth threaded connection portion; and a second threaded rod, one end of the second threaded rod including a seventh threaded connection portion, the seventh threaded connection portion being connected to the fifth threaded connection portion by threads, and the other end of the second threaded rod including an eighth threaded connection portion, and the eighth threaded connection portion being connected to the sixth threaded connection portion by threads.

For example, in the plunger pump base provided by an embodiment of the present disclosure, the second telescopic mechanism further includes: a third rotation nut sleeved on the seventh threaded connection portion of the second threaded rod; and a fourth rotation nut sleeved on the eighth threaded connection portion of the second threaded rod.

For example, the plunger pump base provided by an embodiment of the present disclosure further includes an operation platform arranged adjacent to the support assembly in a direction parallel to the top plate, wherein the operation platform includes a fixed portion and a movable portion, the fixed portion is fixed with the support assembly and extends in a direction away from the support assembly, the fixed portion is provided with a first sliding groove, and the movable portion is slidably connected in the first sliding groove and configured to move in an extending direction of the first sliding groove.

For example, in the plunger pump base provided by an embodiment of the present disclosure, the operation platform includes two fixed portions, the movable portion is located between the two fixed portions, and a side of each of the two fixed portion close to the movable portion is provided with the first sliding groove.

For example, in the plunger pump base provided by an embodiment of the present disclosure, the operation platform further includes: a stopper on the fixed portion and configured to limit a movement of the movable portion.

For example, in the plunger pump base provided by an embodiment of the present disclosure, the movable portion includes: a grid plate including a bearing surface configured to bear an operator; a second sliding groove at a side of the grid plate away from the bearing surface; and a ladder slidably arranged in the second sliding groove, wherein at least one end of the ladder is configured to move in an extending direction of the second sliding groove.

For example, in the plunger pump base provided by an embodiment of the present disclosure, the operation platform further includes: an armrest on a side of the movable portion away from the support assembly.

For example, in the plunger pump base provided by an embodiment of the present disclosure, the support frame includes a receding slot, and the receding slot is located between the top plate and the bottom plate.

For example, in the plunger pump base provided by an embodiment of the present disclosure, the support assembly further includes: a support block at a side of the top plate away from the bottom plate, wherein the support block is provided with a fixing hole extending in a direction perpendicular to the top plate.

For example, the plunger pump base provided by an embodiment of the present disclosure further includes a fixing assembly on a side of the bottom plate away from the top plate, wherein the fixing assembly is configured to be detachably connected to a beam of a carrier.

At least one embodiment of the present disclosure further provides a plunger pump device, which includes a carrier including a beam; a plunger pump base fixed on the beam; and a plunger pump fixed on the plunger pump base, wherein the plunger pump base includes any one of the abovementioned plunger pump base.

For example, in the plunger pump device provided by an embodiment of the present disclosure, the plunger pump is respectively fixed with the support assembly and the extension block.

BRIEF DESCRIPTION OF THE DRAWINGS

In order to more clearly illustrate the technical solution of the embodiments of the present disclosure, the drawings of the embodiments will be briefly described in the following. It is obvious that the described drawings below are only related to some embodiments of the present disclosure without constituting any limitation thereto.

DETAILED DESCRIPTION

Figure 1:
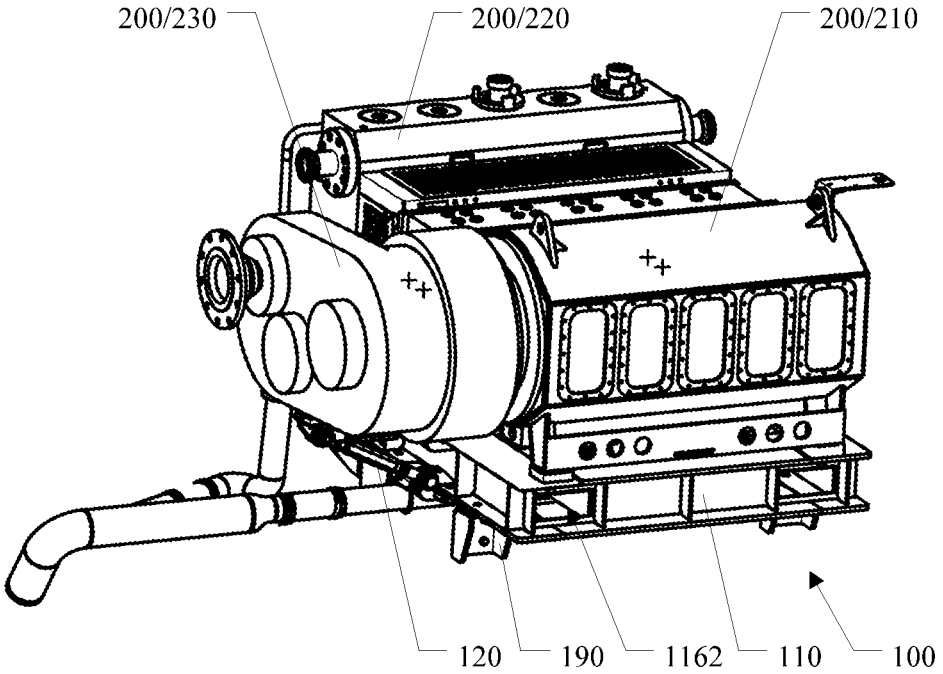
FIG. 1 is a schematic diagram of a plunger pump base according to an embodiment of the present disclosure.

In order to make objectives, technical details and advantages of the embodiments of the present disclosure more clearly, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may comprise an electrical connection, directly or indirectly.

At present, a plunger pump is usually mounted directly on a beam of a carrier (such as a fracturing truck), so as to work normally. However, in the long-term use of a plunger pump, the plunger pump is prone to damage or failure, so it needs to be replaced. Upon a plunger pump is directly mounted on a support beam, it is difficult to disassemble and maintain the plunger pump, and it is prone to damage the plunger pump during disassembly and assembly, thus increasing the damage probability of the plunger pump.

On the other hand, the mounting position of the plunger pump on the beam or the plunger pump base is relatively fixed, so that different sizes of plunger pumps need to adopt different mounting positions or different plunger pump bases, thus increasing the costs.

Therefore, the embodiments of the present disclosure provide a plunger pump base and a plunger pump device. The plunger pump base includes a support assembly and an extension assembly. The support assembly includes a top plate, a bottom plate and a support frame between the top plate and the bottom plate, the top plate and the bottom plate are oppositely arranged at an interval, and the support frame is respectively fixed with the top plate and the bottom plate. The extension assembly includes an extension block, a first telescopic mechanism and a second telescopic mechanism. One end of the first telescopic mechanism is rotatably connected to the extension block, the other end of the first telescopic mechanism is rotatably connected to the top plate, and the first telescopic mechanism is configured to extend or contract. One end of the second telescopic mechanism is rotatably connected to the extension block, and the other end of the second telescopic mechanism is rotatably connected to the bottom plate, and the second telescopic mechanism is configured to extend or contract. In the plunger pump base, the extension block can be used for bearing and fixing a plunger pump, and the extension block, the first telescopic mechanism and the second telescopic mechanism can form a triangular support mechanism with adjustable size. Therefore, upon the lengths of the first telescopic mechanism and the second telescopic mechanism being adjusted, the distance between the extension block and the support assembly will also change, so that it can be used for supporting and fixing plunger pumps of different sizes. In addition, the triangular support mechanism is stable in structure, thus providing stable support for the plunger pump. On the other hand, the plunger pump can be mounted on a beam of a carrier through the plunger pump base, without being disassembled directly on the beam, thus reducing the difficulty of disassembly and maintenance and reducing the damage probability of the plunger pump.

Hereafter, the plunger pump base and plunger pump device provided by the embodiments of the present disclosure will be described in detail with reference to the accompanying drawings.

Figure 2:
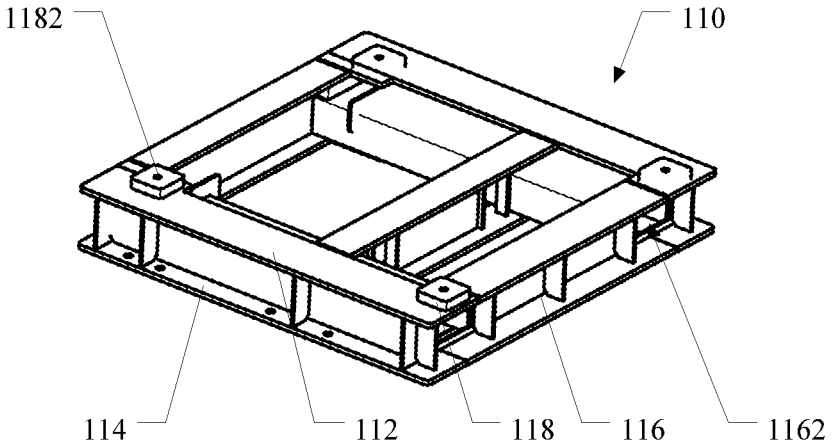
FIG. 2 is a schematic diagram of a support assembly of a plunger pump base according to an embodiment of the present disclosure.
Figure 3:
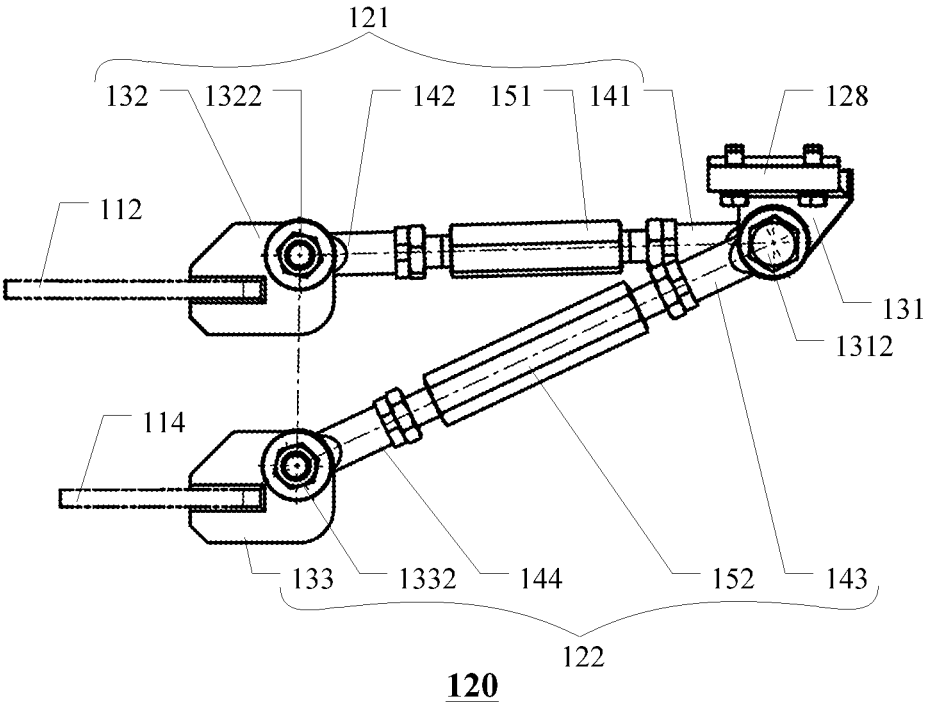
FIG. 3 is a schematic diagram of an extension assembly of a plunger pump base according to an embodiment of the present disclosure.
Figure 4:
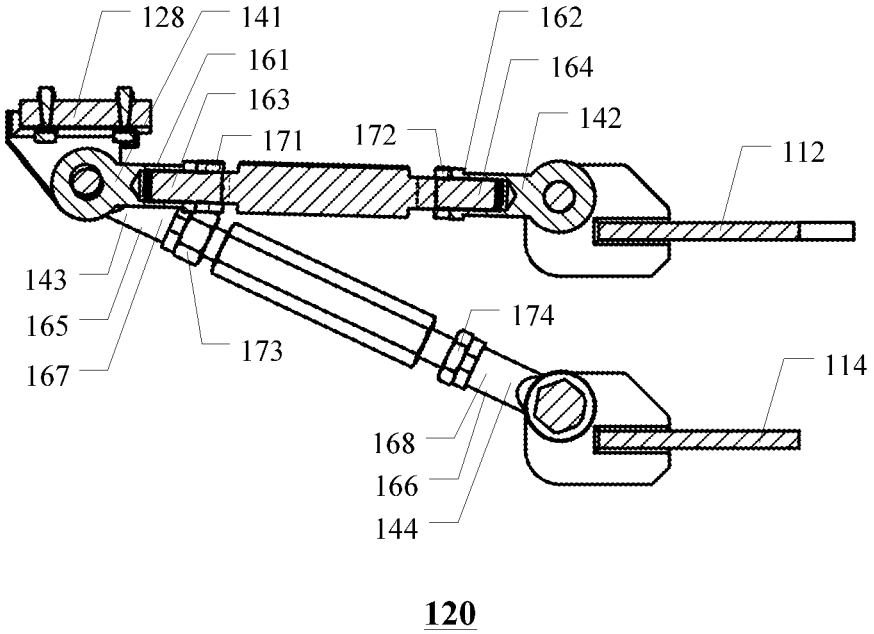
FIG. 4 is a schematic sectional view of an extension assembly of a plunger pump base according to an embodiment of the present disclosure.

An embodiment of the present disclosure provides a plunger pump base. FIG. 1 is a schematic diagram of a plunger pump base according to an embodiment of the present disclosure; FIG. 2 is a schematic diagram of a support assembly of a plunger pump base according to an embodiment of the present disclosure; FIG. 3 is a schematic diagram of an extension assembly of a plunger pump base according to an embodiment of the present disclosure; FIG. 4 is a schematic section view of an extension assembly of a plunger pump base according to an embodiment of the present disclosure.

As illustrated in FIGS. 1 and 2, the plunger pump base 100 includes a support assembly 110 and an extension assembly 120. The support assembly 110 includes a top plate 112, a bottom plate 114 and a support frame 116 located between the top plate 112 and the bottom plate 114, the top plate 112 and the bottom plate 114 are oppositely arranged at an interval, and the support frame 116 is respectively fixed with the top plate 112 and the bottom plate 114. The support assembly 110 is configured to bear and fix the plunger pump. Therefore, the top plate 112, the bottom plate 114 and the support frame 116 can form a stable and firm support structure, and have the advantages of simple structure and light weight.

As illustrated in FIGS. 3 and 4, the extension assembly 120 includes an extension block 128, a first telescopic mechanism 121 and a second telescopic mechanism 122. One end of the first telescopic mechanism 121 is rotatably connected to the extension block 128, and the other end of the first telescopic mechanism 121 is rotatably connected to the top plate 112, and the first telescopic mechanism 121 is configured to extend or contract. One end of the second telescopic mechanism 122 is rotatably connected to the extension block 128, and the other end of the second telescopic mechanism 122 is rotatably connected to the bottom plate 114, and the second telescopic mechanism 122 is configured to extend or contract. It should be noted that the above-mentioned "rotatably connected" means that two portions are connected to each other, and one portion can rotate relative to the other portion at the connection position.

In the plunger pump base provided by the embodiment of the present disclosure, besides the support assembly 110, the extension block 128 can also be used for bearing and fixing the plunger pump, and the extension block 128, the first telescopic mechanism 121 and the second telescopic mechanism 122 can form a triangular support mechanism with adjustable size. Therefore, upon the lengths of the first telescopic mechanism 121 and the second telescopic mechanism 122 being adjusted, the distance between the extension block 128 and the support assembly 110 will also change, which can be used to support and fix plunger pumps of different sizes. In addition, the triangular support mechanism is stable in structure, thus providing stable support for the plunger pump. On the other hand, the plunger pump can be mounted on the beam of the carrier through the plunger pump base 100, without being disassembled directly on the beam, thus reducing the difficulty of disassembly and maintenance and reducing the damage probability of the plunger pump.

In some examples, as illustrated in FIGS. 1 and 2, the support assembly 110 is configured to bear and fix a power end 210 and a hydraulic end 220 of the plunger pump 200. The extension block 128 is configured to bear and fix a gear box 230 of the plunger pump 200.

In some examples, as illustrated in FIGS. 1 and 2, the support frame 116 includes a receding slot 1162 located between the top plate 112 and the bottom plate 114. Therefore, the fork of a forklift can be inserted into the receding slot, so that the plunge pump base can be conveniently moved by the forklift.

For example, the support frame 116 includes two receding slots 1162. The two receding slots 1162 are arranged in parallel and extend in the direction parallel to the top plate 112.

In some examples, as illustrated in FIG. 1 and FIG. 2, the support assembly 110 further includes a support block 118 located on a side of the top plate 112 away from the bottom plate 114, and the support block 118 is provided with a fixing hole 1182 extending in the direction perpendicular to the top plate 112, so that the plunger pump can be conveniently fixed on the support block through the fixing hole and screws or bolts, and then the plunger pump can be fixed on the plunger pump base. It should be noted that the bottom of the plunger pump can also be provided with a through hole corresponding to the above-mentioned fixing hole, so that the plunger pump can be connected and fixed with the support block by bolts. Of course, the embodiments of the present disclosure include but are not limited thereto, and other ways of fixing the plunger pump and the support assembly can also be adopted.

For example, as illustrated in FIG. 1 and FIG. 2, the support assembly 110 also includes four support blocks 118, which are located at four corners of the top plate 112, so as to provide stable support and fixing effect for the plunger pump. Of course, the embodiments of the present disclosure include but are not limited thereto, and the number and positions of the support blocks can be set according to the actual situation.

For example, the fixing hole 1182 can be a through hole or a threaded hole, and the embodiments of the present disclosure are not limited thereto.

In some examples, as illustrated in FIG. 1 and FIG. 2, the plunger pump base further includes a fixing assembly 190 located on a side of the bottom plate 114 away from the top plate 112, and the fixing assembly 190 is configured to be detachably connected to a beam of a carrier. Therefore, the plunge pump base can be conveniently replaced, thereby reduce the difficulty of disassembly and maintenance.

In some examples, the fixing assembly 190 can be detachably connected to the beam of the carrier by bolt connection. Of course, the embodiments of the present disclosure include but are not limited thereto, and other detachable connection modes can also be adopted.

In some examples, as illustrated in FIGS. 3 and 4, the maximum telescopic length of the second telescopic mechanism 122 is greater than the maximum telescopic length of the first telescopic mechanism 121.

In some examples, as illustrated in FIGS. 3 and 4, the extension assembly 120 further includes a first fixed ear-plate 131 and a first connection shaft 1312. The first fixed ear-plate 131 is connected to the extension block 128, and the first connection shaft 1312 is arranged on the first fixed ear-plate 131. One end of the first telescopic mechanism 121 rotatably connected to the extension block 128 is rotatably connected to the first connection shaft 1312, that is, the first telescopic mechanism 121 is rotatably connected to the extension block 128 through the first connection shaft 1312. One end of the second telescopic mechanism 122 rotatably connected to the extension block 128 is rotatably connected to the first connection shaft 1312, that is, the second telescopic mechanism 122 is also rotatably connected to the extension block 128 through the first connection shaft 1312. It should be noted that the embodiments of the present disclosure include but are not limited thereto, and the first telescopic mechanism and the second telescopic mechanism can also be rotatably connected to the extension block in other ways.

In some examples, as illustrated in FIGS. 3 and 4, the first telescopic mechanism 121 includes a first joint bearing 141, a second fixed ear-plate 132, a second connection shaft 1322, a first threaded rod 151 and a second joint bearing 142. One end of the first joint bearing 141 is sleeved on the first connection shaft 1312, and the other end of the first joint bearing 141 includes a first threaded connection portion 161. The second fixed ear-plate 132 is fixed with the top plate 112. The second connection shaft 1322 is arranged on the second fixed ear-plate 132. One end of the second joint bearing 142 is sleeved on the second connection shaft 1322, and the other end of the second joint bearing 142 includes a second threaded connection portion 162. One end of the first threaded rod 151 includes a third threaded connection portion 163, and the third threaded connection portion 163 is connected to the first threaded connection portion 161 by threads. The other end of the first threaded rod 151 includes a fourth threaded connection portion 164, and the fourth threaded connection portion 164 is connected to the second threaded connection portion 162 by threads. Therefore, the first telescopic mechanism can extend and contract by rotating the first threaded rod. Of course, the embodiments of the present disclosure include but are not limited thereto, and the first telescopic mechanism can extend and contract in other forms.

For example, as illustrated in FIG. 3 and FIG. 4, the first threaded connection portion 161 and the second threaded connection portion 162 can be sleeves, and the inner walls thereof are provided with threads. Outer walls of the two ends of the first threaded rod 151 are provided with threads to respectively form the above-mentioned third threaded connection portion 163 and fourth threaded connection portion 164, so that threaded connection can be realized. In this case, one end of the first joint bearing 141 is sleeved on the first connection shaft 1312, and the other end of the first joint bearing 141 includes a first sleeve, that is, the above-mentioned first threaded connection portion 161. One end of the second joint bearing 142 is sleeved on the second connection shaft 1322, and the other end of the second joint bearing 142 includes a second sleeve, that is, the above-mentioned second threaded connection portion 162. One end of the first threaded rod 151 is arranged in the first sleeve and connected to the first sleeve 161 by threads, and the other end of the first threaded rod 151 is arranged in the second sleeve and connected to the second sleeve 162 by threads.

In some examples, as illustrated in FIGS. 3 and 4, the first telescopic mechanism 121 further includes a first rotation nut 171 and a second rotation nut 172. The first rotation nut 171 is sleeved on the third threaded connection portion 163 of the first threaded rod 151. The second rotation nut 172 is sleeved on the fourth threaded connection portion 164 of the first threaded rod 151.

In some examples, as illustrated in FIGS. 3 and 4, the second telescopic mechanism 122 includes a third joint bearing 143, a third fixed ear-plate 133, a third connection shaft 1332, a second threaded rod 152 and a fourth joint bearing 144. One end of the third joint bearing 143 is sleeved on the first connection shaft 1312, and the other end of the third joint bearing 143 includes a fifth threaded connection portion 165. The third fixed ear-plate 132 is fixed with the bottom plate 114. The third connection shaft 1332 is provided on the third fixed ear-plate 133. One end of the fourth joint bearing 144 is sleeved on the third connection shaft 1332, and the other end of the fourth joint bearing 144 includes a sixth threaded connection portion 166. One end of the second threaded rod 152 includes a seventh threaded connection portion 167, and the seventh threaded connection portion 167 is connected to the fifth threaded connection portion 165 by threads. The other end of the second threaded rod 152 includes an eighth threaded connection portion 168, and the eighth threaded connection portion 168 is connected to the sixth threaded connection portion 166 by threads. Therefore, the second telescopic mechanism can extend and contract by rotating the second threaded rod. Of course, the embodiments of the present disclosure include but are not limited thereto, and the second telescopic mechanism can extend and contract in other forms.

For example, as illustrated in FIGS. 3 and 4, the fifth threaded connection portion 165 and the sixth threaded connection portion 166 can be sleeves, and the inner walls thereof are provided with threads. Outer walls of the two ends of the second threaded rod 152 are provided with threads to respectively form the above-mentioned seventh threaded connection portion 167 and eighth threaded connection portion 168, so that threaded connection can be realized. In this case, one end of the third joint bearing 143 is sleeved on the first connection shaft 1312, and the other end of the third joint bearing 143 includes a third sleeve, that is, the above-mentioned fifth threaded connection portion 165. One end of the fourth joint bearing 144 is sleeved on the third connection shaft 1332, and the other end of the fourth joint bearing 144 includes a fourth sleeve, that is, the above-mentioned sixth threaded connection portion 166. One end of the second threaded rod 152 is arranged in the third sleeve and connected to the third sleeve by threads, and the other end of the second threaded rod 152 is arranged in the fourth sleeve and connected to the fourth sleeve by threads.

In some examples, as illustrated in FIGS. 3 and 4, the second telescopic mechanism 122 further includes a third rotation nut 173 and a fourth rotation nut 174. The third rotation nut 173 is sleeved on the seventh threaded connection portion 167 of the second threaded rod 152. The fourth rotation nut 174 is sleeved on the eighth threaded connection portion 168 of the second threaded rod 152.

In some examples, the thread rotation direction of the third threaded connection portion 163 is opposite to the thread rotation direction of the fourth threaded connection portion 164. For example, the threads on the third threaded connection portion 163 can be left-handed threads, and the threads on the fourth threaded connection portion 164 can be right-handed threads. Alternatively, the threads on the third threaded connection portion 163 can be right-handed threads, and the threads on the fourth threaded connection portion 164 can be left-handed threads.

In some examples, similarly, the thread rotation direction of the seventh threaded connection portion 167 is opposite to the thread rotation direction of the eighth threaded connection portion 168. For example, the threads on the seventh threaded connection portion 167 can be left-handed threads, and the threads on the eighth threaded connection portion 168 can be right-handed threads. Alternatively, the threads on the seventh threaded connection portion 167 can be right-handed threads, and the threads on the eighth threaded connection portion 168 can be left-handed threads.

In some examples, as illustrated in FIG. 3 and FIG. 4, the middle of the first threaded rod 151 can be provided with a structure which is convenient for disassembly and assembly, for example, an outer octagonal column structure, an outer hexagonal column structure, an outer quadrangular structure, and the like. Similarly, the middle of the second threaded rod 152 can also be provided with a structure which is convenient for disassembly and assembly, for example, an outer hexagonal column structure, an outer quadrangular structure, and the like.

Figure 5:
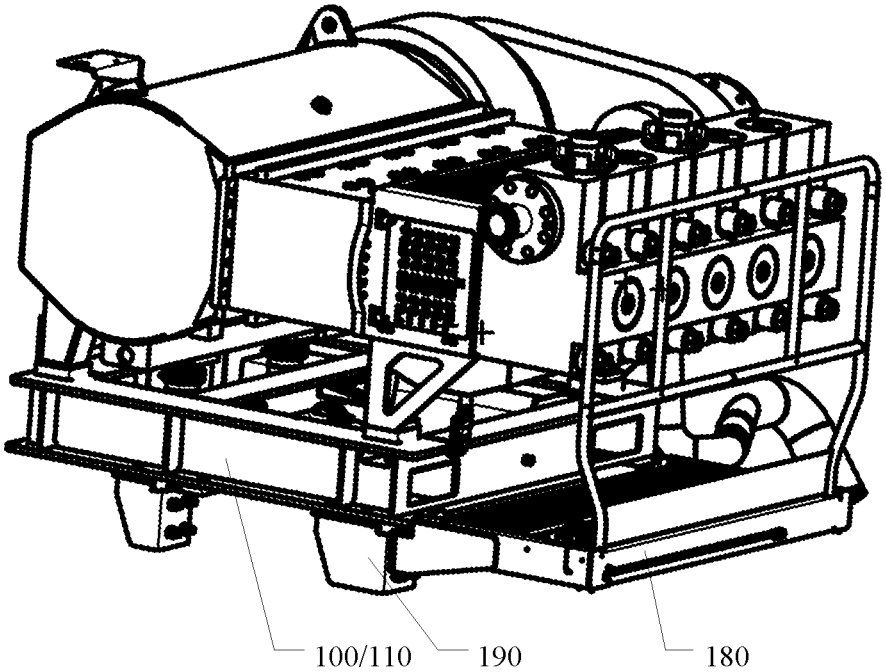
FIG. 5 is a schematic diagram of another plunger pump base according to an embodiment of the present disclosure.
Figure 6:
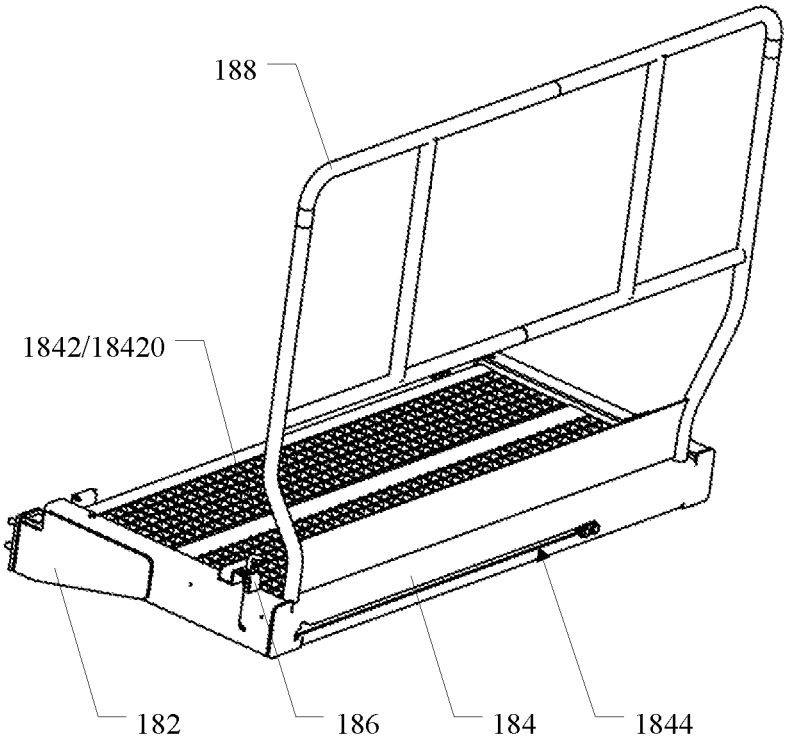
FIG. 6 is a schematic diagram of an operation platform of a plunger pump base according to an embodiment of the present disclosure.
Figure 7:
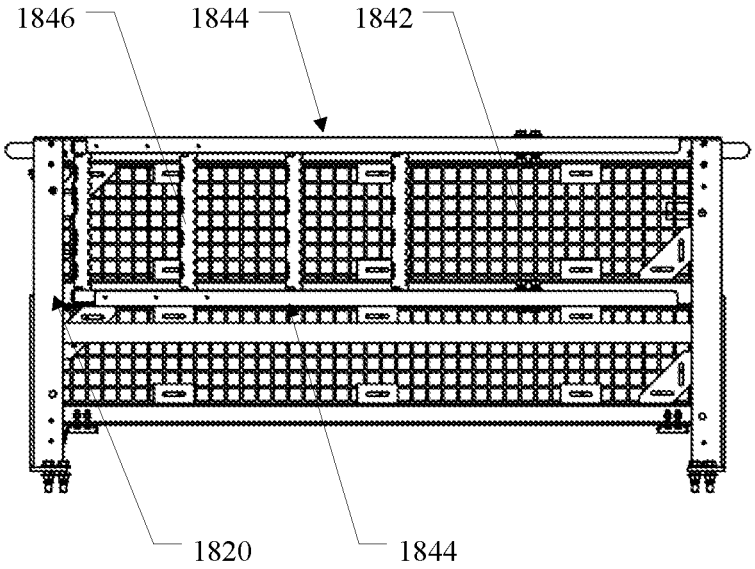
FIG. 7 is a bottom view of an operation platform of a plunger pump base according to an embodiment of the present disclosure.

FIG. 5 is a schematic diagram of another plunger pump base according to an embodiment of the present disclosure. FIG. 6 is a schematic diagram of an operation platform of a plunger pump base according to an embodiment of the present disclosure. FIG. 7 is a bottom view of an operation platform of a plunger pump base according to an embodiment of the present disclosure.

In some examples, as illustrated in FIGS. 5-7, the plunger pump base 100 further includes an operation platform 180, which is arranged adjacent to the support assembly 110 in a direction parallel to the top plate 112 (e.g., horizontal direction). The operation platform 180 includes a fixed portion 182 and a movable portion 184. The fixed portion 182 is fixed with the support assembly 110 and extends in the direction away from the support assembly 110. The fixed portion 182 is provided with a first sliding groove 1820, and the movable portion 184 is slidably connected in the first sliding groove 1820 and configured to move in the extending direction of the first sliding groove 1820. Therefore, the plunger pump base can provide an operation platform for maintenance personnel or repair personnel, thereby reducing the difficulty of maintenance and repair. In addition, because the movable portion of the operation platform can move in the extending direction of the first sliding groove, the space occupied by the operation platform can be increased and reduced by sliding the movable portion, thereby improving convenience.

For example, upon the carrier carrying the plunger pump base being transported, the movable portion can be slid to a position where the first sliding groove is close to the support assembly, that is, a position of the fixed portion close to the support assembly, so that the space occupied by the operation platform can be reduced, and transportation is facilitated. Upon the carrier carrying the plunger pump base being in maintenance, the movable portion can be slid to a position where the first sliding groove is away from the support assembly, that is, a position of the fixed portion away from the support assembly, which can provide a larger operating space for operators.

In some examples, as illustrated in FIG. 5, the operation platform 180 and the extension assembly 120 can be located on two opposite sides of the support assembly 110 in a direction parallel to the top plate 112 (e.g., horizontal direction), so that the space on the two sides of the beam of the carrier can be fully utilized.

In some examples, as illustrated in FIG. 5, the fixed portion 182 of the operation platform 180 can be fixed on the fixing assembly 190 by screws or bolts. Of course, the embodiments of the present disclosure include but are not limited thereto, and the fixed portion of the operation platform can also be fixed on other components of the plunger pump base.

In some examples, as illustrated in FIGS. 5-7, the operation platform 180 includes two fixed portions 182, and the movable portion 184 is located between the two fixed portions 182, and a side of each fixed portion 182 close to the movable portion 184 is provided with the first sliding groove 1820.

In some examples, as illustrated in FIGS. 5-7, the operation platform 180 further includes a stopper 186 located on the fixed portion 182 and configured to limit the movement of the movable portion 184. For example, upon the carrier carrying the plunger pump base being transported, the movable portion can be slid to a position where the first sliding groove is close to the support assembly, that is, a position of the fixed portion close to the support assembly, in this case, the position of the movable portion can be fixed by the stopper to prevent the movable portion from sliding in the first sliding groove. Upon the carrier carrying the plunger pump base being in maintenance, the movable portion can be slid to the position where the first sliding groove is away from the support assembly, that is, a position of the fixed portion away from the support assembly, in this case, the position of the movable portion can also be fixed by the stopper to prevent the movable portion from sliding in the first sliding groove.

For example, the stopper 186 can be a latch. Of course, the embodiments of the present disclosure include but are not limited thereto, and other forms of limiting structures can also be adopted for the stopper.

In some examples, as illustrated in FIGS. 5-7, the movable portion 184 includes: a grid plate 1842 including a bearing surface 18420 configured to bear an operator; a second sliding groove 1844 located on the side of the grid plate 1842 away from the bearing surface 18420; a ladder 1846 slidably arranged in the second sliding groove 1844, and at least one end of the ladder 1846 is configured to move in the extending direction of the second sliding groove 1844. Upon the plunger pump base being fixed on the carrier, the operation platform has a certain height from the ground, therefore, by accommodating the ladder at the bottom of the movable portion, the ladder can be pulled out when it needs to be used, so that it is convenient for maintenance personnel or repair personnel to board the operation platform through the ladder.

In some examples, as illustrated in FIGS. 5-7, the operation platform 180 further includes an armrest 188, which is located on a side of the movable portion 184 away from the support assembly 110 and is fixed on the movable portion 184, thereby providing safety protection for maintenance personnel or repair personnel.

Figure 8:
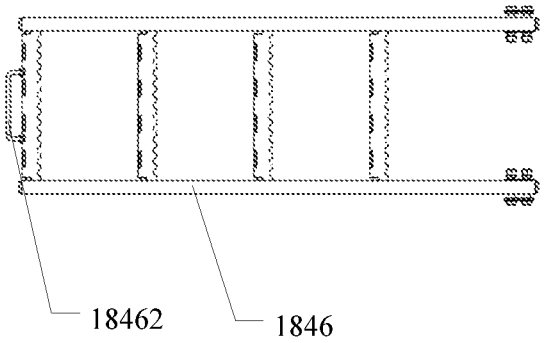
FIG. 8 is a schematic diagram of a ladder of a plunger pump base according to an embodiment of the present disclosure.

FIG. 8 is a schematic diagram of a ladder of a plunger pump base according to an embodiment of the present disclosure. As illustrated in FIG. 8, one end of the ladder 1846 can also include a pull ring 18462, which is convenient for the operator to pull the ladder 1846 out of the second sliding groove 1844.

Figure 9:
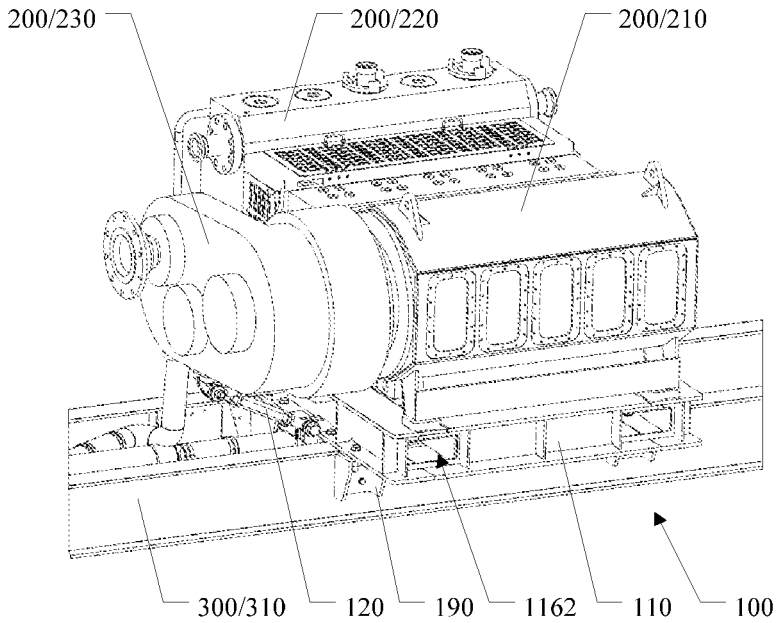
FIG. 9 is a schematic diagram of a plunger pump device according to an embodiment of the present disclosure.

At least one embodiment of the present disclosure further provides a plunger pump device. FIG. 9 is a schematic diagram of a plunger pump device according to an embodiment of the present disclosure. As illustrated in FIG. 9, the plunger pump device 500 includes a carrier 300, a plunger pump base 100 and a plunger pump 200. The carrier 300 includes a beam 310, and the plunger pump base 100 is fixed on the beam 310. The plunger pump 200 is fixed on the plunger pump base 100. Therefore, the plunger pump base can be used for supporting and fixing plunger pumps of different sizes, and can provide stable support for the plunger pumps. On the other hand, the plunger pump can be mounted on the beam of the carrier through the plunger pump base, without being disassembled directly on the beam, thus reducing the difficulty of disassembly and maintenance and reducing the damage probability of the plunger pump.

In some examples, the plunger pump device 500 described above can be a fracturing truck. Of course, the embodiments of the present disclosure include but are not limited thereto, and the above-mentioned plunger pump device can also be other devices including plunger pumps.

In some examples, as illustrated in FIG. 9, the plunger pump 200 is respectively fixed with the support assembly 110 and the extension block 128. Therefore, plunger pumps of different sizes can be supported and fixed by adjusting the position of the extension block, and stable support can be provided for the plunger pump.

For example, the support assembly 110 is configured to bear and fix the power end 210 and the hydraulic end 220 of the plunger pump 200. The extension block 128 is configured to bear and fix the gear box 230 of the plunger pump 200. It should be noted that, usually, the weight of the power end of the plunger pump is relatively large, while the weight of the gear box is relatively light, so the plunger pump can be made more stable in working state through the above arrangement.

The following points need to be noted:

(1) In the drawings of the embodiments of the present disclosure, only the structures related to the embodiments of the present disclosure are involved, and other structures may refer to the common design(s).

(2) In case of no conflict, features in one embodiment or in different embodiments of the present disclosure can be combined.

The above are merely particular embodiments of the present disclosure but are not limitative to the scope of the present disclosure; any of those skilled familiar with the related arts can easily conceive variations and substitutions in the technical scopes disclosed by the present disclosure, which should be encompassed in protection scopes of the present disclosure. Therefore, the scopes of the present disclosure should be defined by the appended claims.

The invention claimed is:

1. A plunger pump base, comprising:

a support assembly, comprising a top plate, a bottom plate and a support frame between the top plate and the bottom plate, the top plate and the bottom plate being oppositely arranged at an interval, the support frame being fixed with the top plate and the bottom plate, wherein the support assembly is configured to bear a plunger pump on the top plate; and an extension assembly, comprising an extension block, a first telescopic mechanism, a second telescopic mechanism, a first fixed ear-plate connected to the extension block, and a first connection shaft on the first fixed ear-plate;

wherein one end of the first telescopic mechanism is rotatably connected to the extension block, an other end of the first telescopic mechanism is rotatably connected to the top plate, and the first telescopic mechanism is configured to extend or contract, one end of the second telescopic mechanism is rotatably connected to the extension block, an other end of the second telescopic mechanism is rotatably connected to the bottom plate, the second telescopic mechanism is configured to extend or contract; and wherein the one end of the first telescopic mechanism rotatably connected to the extension block is rotatably connected to the first connection shaft, and the one end of the second telescopic mechanism rotatably connected to the extension block is rotatably connected to the first connection shaft.

2. The plunger pump base according to claim 1, wherein a maximum telescopic length of the second telescopic mechanism is greater than a maximum telescopic length of the first telescopic mechanism.

3. The plunger pump base according to claim 1, wherein the first telescopic mechanism comprises:

a first joint bearing, one end of the first joint bearing being sleeved on the first connection shaft, and an other end of the first joint bearing comprising a first threaded connection portion;

a second fixed ear-plate fixed with the top plate;

a second connection shaft on the second fixed ear-plate;

a second joint bearing, one end of the second joint bearing being sleeved on the second connection shaft, and an other end of the second joint bearing comprising a second threaded connection portion; and a first threaded rod, one end of the first threaded rod comprising a third threaded connection portion, the third threaded connection portion being connected to the first threaded connection portion by threads, and an other end of the first threaded rod comprising a fourth threaded connection portion, the fourth threaded connection portion being connected to the second threaded connection portion by threads.

4. The plunger pump base according to claim 3, wherein the first telescopic mechanism further comprises:

a first rotation nut sleeved on the third threaded connection portion of the first threaded rod; and a second rotation nut sleeved on the fourth threaded connection portion of the first threaded rod.

5. The plunger pump base according to claim 1, wherein the second telescopic mechanism comprises:

a third joint bearing, one end of the third joint bearing being sleeved on the first connection shaft, and an other end of the third joint bearing comprising a fifth threaded connection portion;

a third fixed ear-plate fixed with the bottom plate;

a third connection shaft on the third fixed ear-plate;

a fourth joint bearing, one end of fourth joint bearing being sleeved on the third connection shaft, and an other end of fourth joint bearing comprising a sixth threaded connection portion; and a second threaded rod, one end of the second threaded rod comprising a seventh threaded connection portion, the seventh threaded connection portion being connected to the fifth threaded connection portion by threads, and an other end of the second threaded rod comprising an eighth threaded connection portion, and the eighth threaded connection portion being connected to the sixth threaded connection portion by threads.

6. The plunger pump base according to claim 5, wherein the second telescopic mechanism further comprises:

a third rotation nut sleeved on the seventh threaded connection portion of the second threaded rod; and a fourth rotation nut sleeved on the eighth threaded connection portion of the second threaded rod.

7. The plunger pump base according to claim 1, further comprising:

an operation platform arranged adjacent to the support assembly in a direction parallel to the top plate, wherein the operation platform comprises a fixed portion and a movable portion, the fixed portion is fixed with the support assembly and extends in a direction away from the support assembly, the fixed portion is provided with a first sliding groove, and the movable portion is slidably connected in the first sliding groove and configured to move in an extending direction of the first sliding groove.

8. The plunger pump base according to claim 7, wherein the operation platform comprises two fixed portions, the movable portion is located between the two fixed portions, and a side of each of the two fixed portions close to the movable portion is provided with the first sliding groove.

9. The plunger pump base according to claim 7, wherein the operation platform further comprises:

a stopper on the fixed portion and configured to limit a movement of the movable portion.

10. The plunger pump base according to claim 7, wherein the movable portion comprises:

a grid plate comprising a bearing surface configured to bear an operator;

a second sliding groove at a side of the grid plate away from the bearing surface; and a ladder slidably arranged in the second sliding groove, wherein at least one end of the ladder is configured to move in an extending direction of the second sliding groove.

11. The plunger pump base according to claim 10, wherein the operation platform further comprises:

an armrest on a side of the movable portion away from the support assembly.

12. The plunger pump base according to claim 1, wherein the support frame comprises a receding slot, and the receding slot is located between the top plate and the bottom plate.

13. The plunger pump base according to claim 1, wherein the support assembly further comprises:

a support block at a side of the top plate away from the bottom plate, wherein the support block is provided with a fixing hole extending in a direction perpendicular to the top plate.

14. The plunger pump base according to claim 1, further comprising:

a fixing assembly on a side of the bottom plate away from the top plate, wherein the fixing assembly is configured to be detachably connected to a beam of a carrier.

15. A plunger pump device, comprising:

a carrier comprising a beam;

the plunger pump base of claim 1 fixed on the beam; and the plunger pump fixed on the plunger pump base.

16. The plunger pump device according to claim 15, wherein the plunger pump is respectively fixed with the support assembly and the extension block.

* * * * *